US012030536B2

(12) United States Patent
Oswald et al.

(10) Patent No.: US 12,030,536 B2
(45) Date of Patent: Jul. 9, 2024

(54) MONITORING SYSTEM

(71) Applicant: Westinghouse Air Brake Technologies Corporation, Pittsburgh, PA (US)

(72) Inventors: Jim Oswald, Cedar Rapids, IA (US); Kendrick Gawne, Cedar Rapids, IA (US); Phillip Burgart, Cedar Rapids, IA (US)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 262 days.

(21) Appl. No.: 17/534,169

(22) Filed: Nov. 23, 2021

(65) Prior Publication Data

US 2022/0185346 A1 Jun. 16, 2022

Related U.S. Application Data

(60) Provisional application No. 63/126,192, filed on Dec. 16, 2020.

(51) Int. Cl.

| | |
|---|---|
| ***B61L 15/00*** | (2006.01) |
| ***B61L 25/02*** | (2006.01) |
| ***B61L 27/04*** | (2006.01) |

(52) U.S. Cl.

CPC ..... *B61L 15/0062* (2024.01); *B61L 15/0058* (2024.01); *B61L 15/0081* (2013.01); *B61L 25/025* (2013.01); *B61L 27/04* (2013.01); *B61L 2201/00* (2013.01)

(58) Field of Classification Search

CPC ..... B61L 3/008; B61L 3/006; B61L 15/0081

See application file for complete search history.

(56) References Cited

U.S. PATENT DOCUMENTS

| | | | | |
|---|---|---|---|---|
| 5,629,567 | A * | 5/1997 | Kumar | B60L 3/10 290/9 |
| 2004/0006413 | A1* | 1/2004 | Kane | B61L 15/0081 701/19 |
| 2010/0241296 | A1* | 9/2010 | Rhea, Jr. | B60T 17/228 701/20 |
| 2012/0173055 | A1* | 7/2012 | Yamamoto | B61L 25/026 701/20 |
| 2019/0281578 | A1* | 9/2019 | Nabetani | H04B 7/022 |

FOREIGN PATENT DOCUMENTS

| | | | | |
|---|---|---|---|---|
| CA | 2748205 | A1 * | 7/2010 | A63G 7/00 |

* cited by examiner

*Primary Examiner* — George C Jin
(74) *Attorney, Agent, or Firm* — K&L Gates LLP

(57) ABSTRACT

A monitoring system includes a sensor that may output a sensed moving speed of a vehicle system. The monitoring system may also include one or more processors in communication with the sensor. The one or more processors may calculate a predicted speed of the vehicle system based on one or more forces acting on the vehicle system, and compare the predicted speed with the sensed moving speed. The one or more processors may also control movement of the vehicle system based on comparing the predicted speed with the sensed moving speed.

20 Claims, 3 Drawing Sheets

MONITORING SYSTEM

CROSS REFERENCE

This application claims priority to U.S. Provisional Application No. 63/126,192, which was filed on 16 Dec. 2020, and the entire disclosure of which is incorporated herein by reference.

BACKGROUND

Technical Field

The subject matter described relates to systems and methods that monitor vehicles of a vehicle system.

Discussion of Art

A positive vehicle control (PVC) system is a monitoring system that monitors the locations of numerous vehicles in a network of routes and communicates with the vehicles to prevent collisions or other unsafe traveling conditions. PVC systems may operate by determining which segments of routes are occupied by vehicles, are undergoing maintenance, or the like, and generating signals that inform the respective vehicles as to whether the vehicles can enter into certain route segments. Without receiving such a signal, the PVC system may prevent the respective vehicle from entering a route segment. One example of a PVC system is a positive train control (PTC) system.

A PVC system may need accurate speed readings related to vehicles within the vehicle system. Specifically, PVC systems may determine an accurate speed to safely predict when to enforce a target. The calculated braking curves are very dependent on speed and even a small error in speed (e.g., one to two miles per hour) can have a significant effect on calculated braking distance. PVC systems may use multiple sensors that are compared and filtered to determine an accurate speed. In a rail vehicle setting, the primary speed source is a wheel tachometer. Still, because the tachometer is directly coupled to the wheel of a locomotive, the tachometer is prone to detect speed changes when the wheel slips or slides along the rail. Therefore, PVC systems may use alternate speed sources such as GPS to filter and validate speed so that a wheel slip or slide event can be detected and handled by some means that is safe and maintains accuracy.

However, for some vehicles, navigation satellite systems can be insufficient to determine the speed of the vehicle. For example, vehicles often travel through tunnels, in and out of buildings, in remote locations, in urban locations having tall buildings, in mountainous regions, etc., all of which can result in spotty navigation system coverage and difficulties in determining vehicle location. As a result, when a speed change is detected as a result of wheel slip and the navigation satellite system is unable to accurately determine the speed of the vehicle, the PVC system often cannot identify the wheel slip, resulting in inaccurate determination by the PVC system.

The current wheel slip/slide detection design monitors the wheel tachometer speed for a large acceleration or deceleration within a short time period (e.g., one second) as a potential slip or slide event. Speed is then compared against a speed determined by the navigation satellite system. Because of inaccuracies of the speed determined by the wheel tachometer, the speed determined by the PVC system is determined to be the last or previously determined tachometer speed (determined before the slip or slide event).

The last determined tachometer speed is then used for calculating braking curves to restrict movement for up to ten seconds until the wheel tachometer speed again matches the speed determined by the navigation satellite system. In this manner, the braking curve calculations are made utilizing the last determined speed until the match occurs to account for slip or slide events. In most actual slip or slide events, the locomotive monitoring system corrects the loss of adhesion causing the slip or slide event, and the wheel tachometer and satellite navigation system speed sources converge again, and the true speed of the locomotive is once again known. Still, such methodology leads to long periods before convergence back to the correct vehicle speed as a result of a wheel slip, resulting in inaccurate information being gathered and utilized by the PVC system during that time period. Using inaccurate speeds to determine how to control vehicles during movement of the vehicles can result in unsafe operation of the vehicles, especially at faster speeds. Therefore, a need may exist for a monitoring system that includes a PVC that differs from those currently known.

BRIEF DESCRIPTION

In one or more embodiments, a monitoring system may include a sensor that outputs a sensed moving speed of a vehicle system. The monitoring system may also include one or more processors in communication with the sensor. The one or more processors may be configured to determine a predicted speed of the vehicle system based on one or more forces acting on the vehicle system, and to compare the predicted speed with the sensed moving speed. The one or more processors may also be configured to control movement of the vehicle system based on comparing the predicted speed with the sensed moving speed.

In one or more embodiments, a monitoring system is provided that includes a sensor and one or more processors. The one or more processors may be configured to monitor a sensed moving speed of a vehicle system based on output from the sensor and to determine a predicted speed of the vehicle system based on one or more forces acting on the vehicle system. The one or more processors may be configured to compare the predicted speed with the sensed moving speed, and to control movement of the vehicle system based on comparing the predicted speed with the sensed moving speed. The one or more processors may also be configured to determine whether a wheel slip occurred based on comparing the predicted speed with the sensed moving speed.

In one or more embodiments, a method includes sensing, with a sensor, a sensed moving speed of a vehicle system. The method may also include determining a predicted speed of the vehicle system based on one or more forces acting on the vehicle system, and comparing the predicted speed with the sensed moving speed. The method may also include controlling movement of the vehicle system based on comparing the predicted speed with the sensed moving speed.

BRIEF DESCRIPTION OF THE DRAWINGS

The inventive subject matter may be understood from reading the following description of non-limiting embodiments, with reference to the attached drawings, wherein below.

DETAILED DESCRIPTION

Embodiments of the subject matter described herein relate to systems and methods that calculate the speed of a vehicle based on forces acting upon the vehicle when a wheel slip or slide is detected. When a potential wheel slip or slide occurs, the system may use a calculated vehicle speed until the tachometer speed matches the calculated vehicle speed, or a positional moving speed as determined utilizing an off-board source such as a satellite navigation system. The calculated speed may be based upon the forces acting on the vehicle, including route grade, route curvature, resistive forces, motor forces including tractive forces and dynamic braking, air braking, control settings including throttle position and brake pipe pressure (BPP) drop, etc. By utilizing calculated speed for braking calculations, when a wheel slip or slide event is detected, more accurate braking calculations are achieved.

A PVC system is a monitoring system utilized by a vehicle system to allow the vehicle system to move within a designated restricted manner (such as above a designated penalty speed limit, to enter another route segment, etc.) only responsive to receipt or continued receipt of one or more signals (e.g., received from off-board the vehicle) that meet designated criteria, e.g., the signals have designated characteristics (e.g., a designated waveform and/or content), are received at designated times (or according to other designated time criteria), and/or under designated conditions. For example, the vehicle may be automatically prevented from entering into another route segment unless a signal is received by the PVC system indicating that the other route segment does not include any other vehicles, may be automatically prevented from moving at speeds above a speed limit when a route segment has a maintenance crew present, etc. This is opposed to 'negative' vehicle monitoring systems where a vehicle is allowed to move unless a signal (restricting movement) is received.

Not all embodiments described herein are limited to rail vehicle systems, or PVC systems. For example, one or more embodiments of the detection systems and methods described herein can be used in connection with other types of vehicles, such as automobiles, trucks, buses, mining vehicles, marine vessels, aircraft, agricultural vehicles, or the like. As another example, one or more embodiments can be used with vehicle control systems other than PVC systems to change movement of a vehicle. For example, a negative vehicle monitoring system (e.g. where a vehicle is allowed to move unless a signal restricting movement is received) could be utilized to change the movement of a vehicle.

Figure 1:
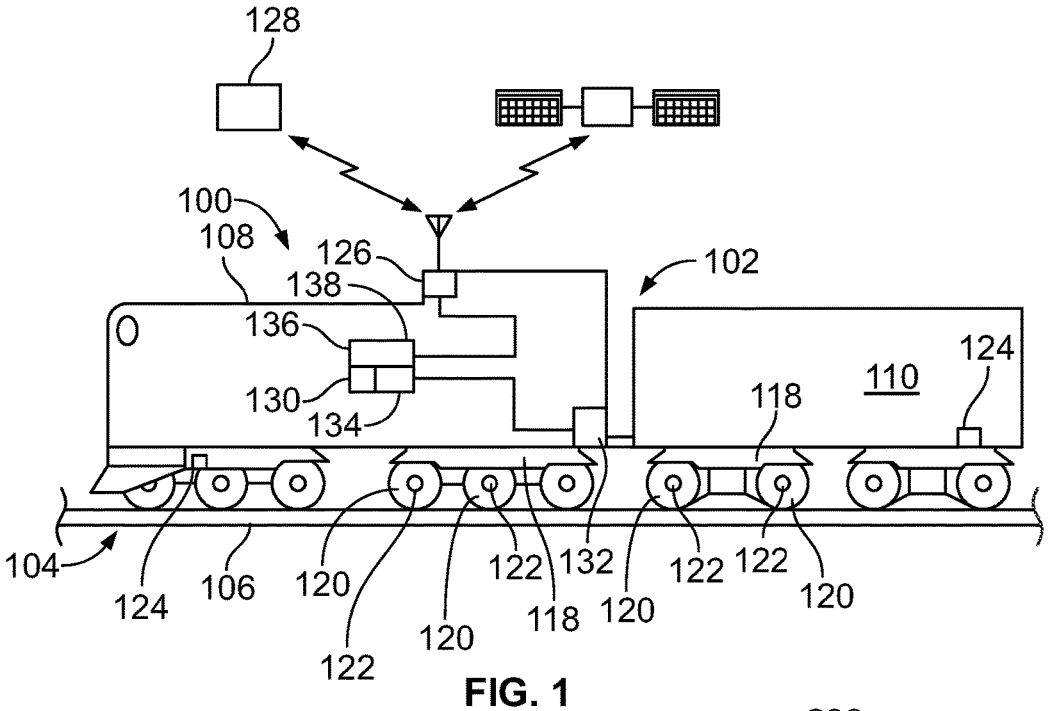
FIG. 1 illustrates a block schematic diagram of a vehicle system.

FIG. 1 illustrates a schematic diagram of one example of a vehicle system 100 that includes a monitoring system 102. The vehicle system may also travel along a route 104 on a trip from a starting or departure location to a destination or arrival location. The vehicle system includes at least one propulsion-generating vehicle 108 and, optionally, a non-propulsion-generating vehicle 110 that are mechanically connected or interconnected to one another to travel together along the route. Alternatively, the vehicle system may be formed of only a single propulsion-generating vehicle. In yet another embodiment, the vehicles in the vehicle system are logically or virtually coupled together, but not mechanically coupled together.

The propulsion-generating vehicle may generate tractive efforts to propel (for example, pull or push) the vehicle system along routes. The propulsion-generating vehicle includes a propulsion subsystem, such as an engine, one or more traction motors, or the like, that operate to generate tractive effort to propel the vehicle system. The propulsion-generating vehicle also includes a braking system 112 that generates braking effort to slow or stop movement of the vehicle system. Although one propulsion-generating vehicle and one non-propulsion-generating vehicle are shown in FIG. 1, the vehicle system may include multiple propulsion-generating vehicles and/or multiple non-propulsion-generating vehicles.

In the example of FIG. 1, the vehicles of the vehicle system each include multiple wheels 120 that engage the route and at least one axle 122 that couples left and right wheels together (only the left wheels are shown in FIG. 1). Optionally, the wheels and axles are located on one or more trucks or bogies 118. Optionally, the trucks may be fixed-axle trucks, such that the wheels are rotationally fixed to the axles, so the left wheel rotates the same speed, amount, and at the same times as the right wheel. In one embodiment, the vehicle system may not include axles, such as in some mining vehicles, electric vehicles, etc.

Movement of at least one wheel is monitored by a wheel speed sensor 124 that detects rotation of the wheel that can be used to determine a sensed moving speed of the vehicle system. The wheel speed sensor may be coupled to the wheel, the axle, the vehicle system, a wayside device, etc. and positioned to detect characteristics of the wheel that may be used to determine the sensed moving speed of the vehicle system. In one example, the wheel speed sensor is a tachometer. In another example, an iterative learning control sensor or algorithm may be utilized to determine the sensed moving speed of the vehicle system.

The monitoring system may further include a wireless communication system 126 that allows wireless communications between vehicles in the vehicle system and/or with remote locations, such as the remote (e.g., dispatch) location 128. The communication system may include a receiver and a transmitter, or a transceiver that performs both receiving and transmitting functions. The communication system may also include an antenna and associated circuitry.

The monitoring system further includes a trip characterization element 130. The trip characterization element may provide information about the trip of the vehicle system along the route. The trip information may include route characteristics, designated locations, designated stopping locations, schedule times, meet-up events, directions along the route, and the like.

For example, the route characteristics may include grade, elevation slow warnings, environmental conditions (e.g., rain and snow), and curvature information. The trip information concerning schedule times may include departure times and arrival times for the overall trip, times for reaching designated locations, and/or arrival times, break times (e.g., the time that the vehicle system may be stopped), and departure times at various designated stopping locations during the trip. The trip characterization element may also include vehicle control setting for the trip, including throttle settings, dynamic braking settings, etc. The trip characterization element may be a database stored in an electronic storage device, or memory. The information in the trip characterization element 130 may be input via the user interface device by an operator, may be automatically uploaded, or may be received remotely via the communication system. The source for at least some of the information in the trip characterization element may be a trip manifest, a log, or the like.

In an embodiment, the monitoring system may include a vehicle characterization element 134. The vehicle characterization element may provide information about the make-up of the vehicle system, such as the type of non-propulsion-generating vehicles (for example, the manufacturer, the product number, the materials, etc.), the number of non-propulsion-generating vehicles, the weight of non-propulsion-generating vehicles, whether the non-propulsion-generating vehicles are consistent (meaning relatively identical in weight and distribution throughout the length of the vehicle system) or inconsistent, the type and weight of cargo, the total weight of the vehicle system, the number of propulsion-generating vehicles, the position and arrangement of propulsion-generating vehicles relative to the non-propulsion-generating vehicles, the type of propulsion-generating vehicles (including the manufacturer, the product number, power output capabilities, available notch settings, fuel usage rates, etc.), and the like.

The vehicle characterization element may be a database stored in an electronic storage device, or memory. The information in the vehicle characterization element may be input using an input/output (I/O) device (referred to as a user interface device) by an operator, may be automatically uploaded, or may be received remotely via the communication system. The source for at least some of the information in the vehicle characterization element may be a vehicle manifest, a log, or the like.

The vehicle system may also include a locator device 136. The locator device may be positioned on the vehicle system, utilize wayside devices, etc. In one example, the locator device is a global navigation satellite system such as a global positioning system (GPS) that provides position data related to the vehicle system. Alternatively, the locator device may be or may implement WiFi, Bluetooth enabled beacons, near-field communication (NFC), radio frequency identification (RFID), QR code, etc. to provide location information.

Figure 2:
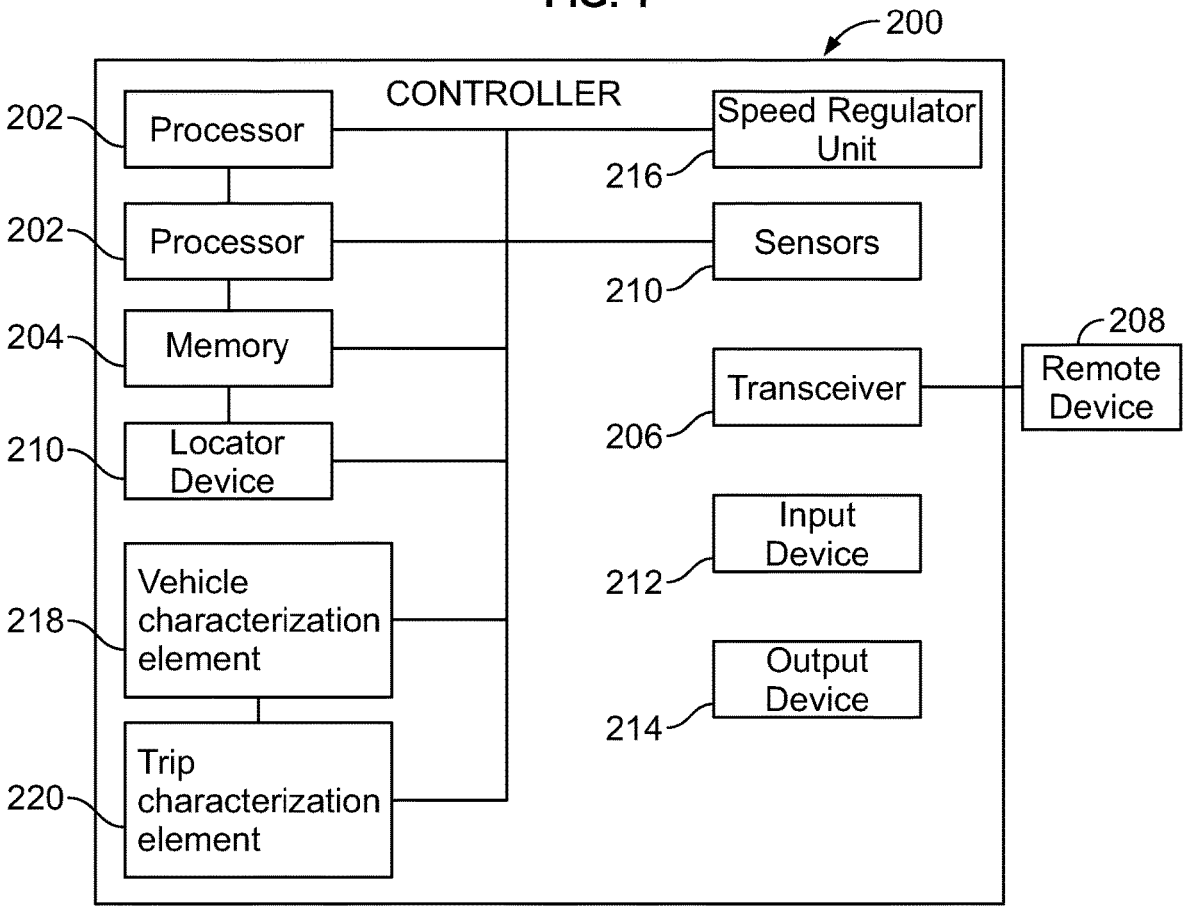
FIG. 2 illustrates block schematic diagram of a controller.

FIG. 2 provides a schematic illustration of a controller 200 that may control operation of a propulsion-generating vehicle. In one example, the controller represents the controller in FIG. 1. The controller may be a device that includes one or more processors 202 (microprocessors, integrated circuits, field programmable gate arrays, etc.). The one or more processors may determine the speed of the vehicle system based on a sensor reading, and/or based on one or more force parameters. Force parameters may represent or be used to determine a force on the vehicle system to vary the speed of the vehicle system. Force parameters may include route grade, route curvature, resistive forces, motor tractive forces, dynamic braking, air braking, throttle position, brake pipe pressure drop, or the like.

The controller optionally may also include a controller memory 204, which may be an electronic, computer-readable storage device or medium. The controller memory may be within the housing of the controller, or alternatively may be on a separate device that may be communicatively coupled to the controller and the one or more processors therein. By "communicatively coupled," it is meant that two devices, systems, subsystems, assemblies, modules, components, and the like, are joined by one or more wired or wireless communication links, such as by one or more conductive (e.g., copper) wires, cables, or buses; wireless networks; fiber optic cables, and the like. The controller memory can include a tangible, non-transitory computer-readable storage medium that stores data on a temporary or permanent basis for use by the one or more processors. The memory may include one or more volatile and/or non-volatile memory devices, such as random access memory (RAM), static random access memory (SRAM), dynamic RAM (DRAM), another type of RAM, read only memory (ROM), flash memory, magnetic storage devices (e.g., hard discs, floppy discs, or magnetic tapes), optical discs, and the like. The memory may be utilized to store information related to vehicle parameters, route parameters, trip parameters, or the like. Vehicle parameters may include vehicle weight, wheel diameter, tachometer readings, throttle settings, brake settings, speeds, brake settings, accelerations, etc. Route parameters may include route grade, route weather, route curvature, etc. Trip parameters may include destination, speed limits for areas, traffic congestion, break locations, tunnel locations, or the like.

The controller may also include a transceiver 206 that may communicate with a remote device 208. The transceiver may be a single unit or be a separate receiver and transmitter. In one example, the transceiver may only transmit signals. The remote device 208 may be a dispatch controller, a controller of another vehicle, a second controller coupled to the vehicle system, a controller within a wayside device, or the like. In one example, the remote device is a PVC system as described herein, and more specifically, in one embodiment a positive train control (PTC) system. The PVC system may receive speed information from the transceiver, determine and/or calculate the speed of the vehicle system, restrict movement of one or more vehicle systems based on a set of rules, etc.

The controller may also include one or more sensors 210 coupled to the vehicle system to detect vehicle parameters, route parameters, trip parameters, or the like. In one embodiment, at least one sensor is a wheel speed sensor that detects information that may be utilized to calculate a sensed moving speed of the vehicle system. In one example, the wheel speed sensor is a tachometer coupled to the wheel. The one or more sensors may also include a locator device such as a GPS that provides the location of the vehicle system. The sensors may be coupled to the vehicle system, adjacent a vehicle system, or otherwise. For example, a weather sensor that is in communication with the one or more processors, even when in a remote location, may be considered a sensor of the controller. The one or more sensors may also include auxiliary sensors that monitor force parameters related to the vehicle system that may be utilized to determine a predicted speed of the vehicle system. In one example, the predicted speed may be a positional moving speed, a calculated moving speed, or the like.

The controller may also include an input device 212 and an output device 214. Specifically, the input device may be an interface between an operator and the one or more processors. The input device may include a display or touch screen, input buttons, ports for receiving memory devices, etc. In this manner, an operator may manually provide parameters into the controller, including vehicle parameters, route parameters, and trip parameters. Similarly, the output device may present information and data to an operator, or provide prompts for information and data. The output device may similarly be a display or touch screen. In this manner, a display or touch screen may be an input device and an output device.

The controller can additionally include a speed regulator unit 216. The speed regulator unit receives inputs from the sensors, memory, input device, etc. and makes determinations regarding the speed of the vehicle. In particular, the speed regulator unit may receive inputs from a vehicle characterization element 218 and/or a trip characterization element 220 that are also part of the controller. In one example, the speed regulator unit receives input from a tachometer and determines the speed of the vehicle based on a calculation, lookup table, algorithm, or the like to determine the vehicle speed. The speed regulator unit may also receive or obtain a threshold rate and threshold amount, and determine changes of rate of the speed of the vehicle. Specifically, the speed regulator unit 216 may determine if the sensed moving speed of the vehicle system change at a rate that is faster than the threshold rate or changes by more than a threshold amount.

In one example, the threshold rate is 3 miles per hour per second, such that the speed regulator unit may determine that the sensed moving speed decelerates or accelerates more than 3 miles per hour per second. Such a threshold rate indicates that a wheel can potentially be slipping or sliding, and the sensor is detecting the change in wheel rotation rate only, and not a change in vehicle system rate. In another example, the threshold amount may be 5 miles per hour from a determined speed. Specifically, during a trip often a vehicle system is to maintain a constant speed during section of the trip. Thus, an increase above or below that speed in a section may be indicative of a wheel slip. When used herein, wheel slip refers to any undesired movement of the wheel, including wheel slip, wheel slide, or the like. Similarly, the threshold amount may be 3 mph from a calculated or predicted speed. Specifically, based on the operational settings, route inclines or declines, vehicle system weight, etc., the speed regulator unit may determine a calculated or predicted speed of the vehicle system for any given portion of a route. If the speed determined from a sensor exceeds the threshold amount from the calculated or predicted speed, a wheel slip condition may be presented. In yet another example, the calculated or predicted speed may be determined by a remote device, and communicated to the speed regulator unit, and the threshold amount may be an amount from such communicated calculated moving speed.

The speed regulator unit may also determine whether to restrict the movement of the vehicle system based on a calculated speed and not based on the sensed moving speed that is output from the sensor. In one example, the monitoring system, via the speed regulator unit, continuously provides vehicle speed information to a remote device. In one example, the remote device is a PVC system that receives similar input from other vehicles systems traveling the same or similar routes. Based on the speed information received, the PVC system determines and communicates speed restrictions to the speed regulator unit to prevent collisions, and provide safer traveling conditions. So, when a potential wheel slip is determined by the speed regulator unit, instead of sending the sensed moving speed as determined by a wheel speed sensor, the speed regulator unit determines to have the PVC system utilize a calculated speed of the vehicle.

In one embodiment, the speed regulator unit calculates the speed of the vehicle based on parameters. For example, based on the throttle position, grade of the route, and weight of the vehicle, a prediction may be made regarding the speed of the vehicle. Such a prediction may be made through an algorithm, mathematical equation, lookup table, mathematical function, etc. Alternatively, the PVC system may make the prediction and communicate the prediction to the speed regulator unit. The calculated vehicle speed is then the vehicle speed communicated to the PVC system to determine restriction of movement of the vehicle system based on vehicle speed.

After the speed regulator unit determines to communicate the calculated speed to the PVC system instead of the sensed vehicle speed, the monitoring system continues to determine whether to restrict the movement of the vehicle system based at least on the sensed moving speed and not based on the calculated speed. Specifically, once the wheel slip has been verified, the speed regulator unit communicates the sensed vehicle speed. In one embodiment, to verify the wheel slip, in response to a rate or an amount threshold being exceeded, the one or more processors receive global positioning data, and based on the global positioning data, the positional moving speed of the vehicle system is continuously determined, and compared to the sensed vehicle speed. Once the positional moving speed matches, or is within a tolerance of the sensed wheel speed, a determination is made that the wheel either did not slip, or has completed slipping. In one example, the tolerance is 2 miles per hour. As a result of the determination, the speed regulator unit communicates the sensed vehicle speed again to the PVC system to restrict movement of the vehicle system based on the wheel speed sensor.

Figure 3:
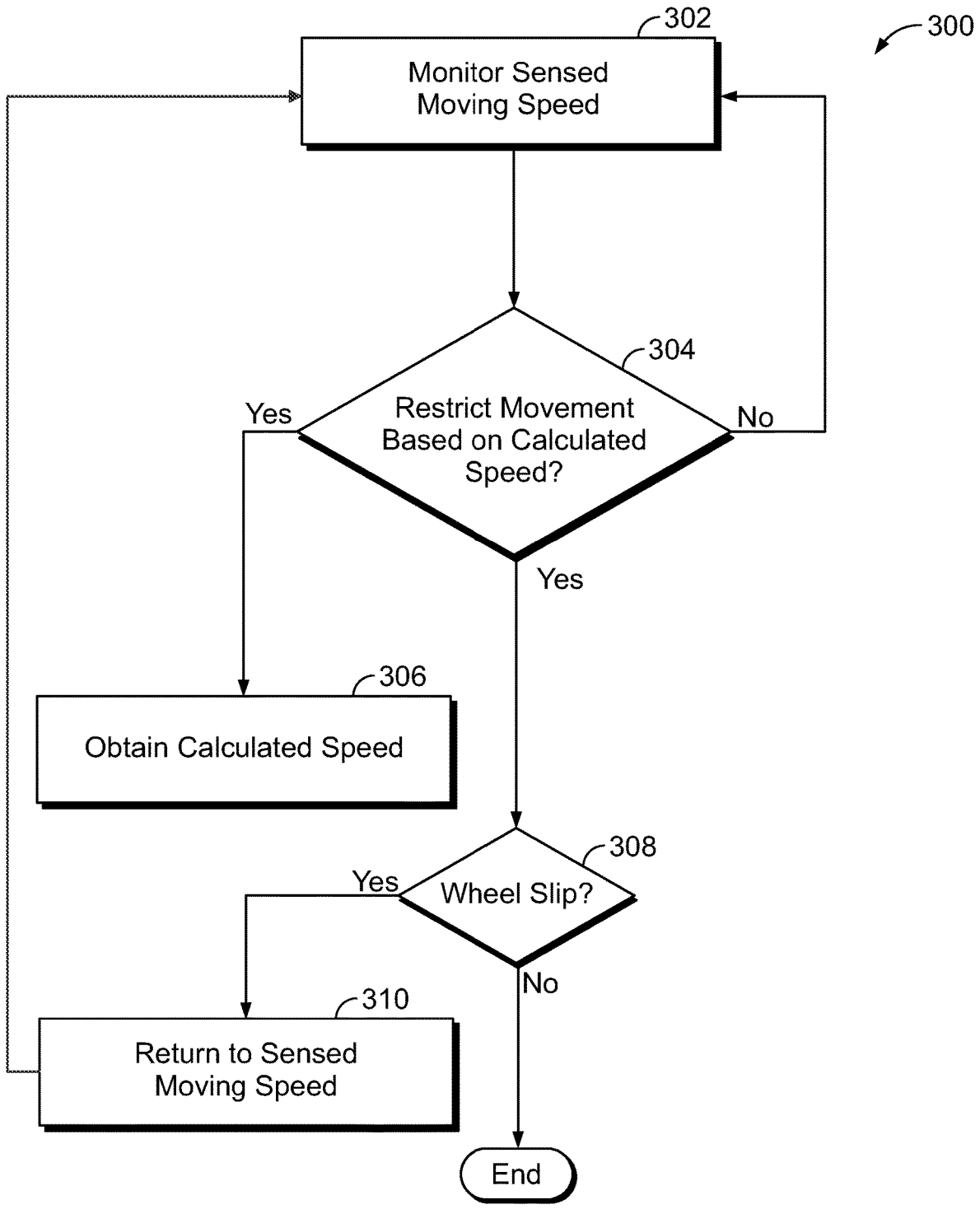
FIG. 3 illustrates a block schematic diagram of a method of restricting the movement of a vehicle system.

FIG. 3 illustrates a block diagram of a method 300 of restricting the movement of a vehicle system. In one example, the monitoring system of FIG. 2 is utilized to implement the method.

At step 302, a sensed moving speed of a vehicle system is monitored based on output from a sensor using a monitoring system that may automatically restrict movement of the vehicle system based at least on the sensing moving speed that is monitored. In one example, the sensor is a wheel speed sensor, and specifically may be a tachometer. The tachometer detects the frequency of rotations of the wheel to determine revolutions per minute, that is utilized to determine the resulting sensed moving speed of the vehicle.

In another example, the monitoring system is a PVC system, or a controller utilizing PVC system protocols that may be in communication with numerous vehicle systems that travel the same or similar routes. Based on the movements of all of the different vehicle systems the PVC system restricts the movement of individual vehicle systems to prevent collisions and improve safety along the routes. In an embodiment when the vehicle systems are rail vehicles, and the monitoring system utilizes PVC system protocols, when a first rail vehicle is on a first rail, and a second rail vehicle is on a second rail that converges with the first track, the monitoring system monitors the speed of both the first rail vehicle and the second rail vehicle. If from monitoring the speed of the first and second rail vehicles a determination is made that the front of the second rail vehicle will collide with non-propulsion-generating vehicles at the back end of the first rail vehicle when the second rail merges into the first rail, the monitoring system will automatically reduce the speed of the second rail vehicle to prevent the collision. By reducing the speed of the second rail vehicle, the movement of the second rail vehicle is restricted, thus preventing collision at the merge point between the first and second rails.

In another example, the first rail vehicle and second rail vehicle may be traveling along the same track. If the first rail vehicle comes upon standing water on the track and is forced to stop, the controller similarly will stop the movement of the second rail vehicle to prevent the second rail vehicle from hitting the back end of the first rail vehicle.

At step 304, a determination is made whether to restrict the movement of the vehicle system based at least on a calculated speed and not based on the sensed moving speed. In particular, if the threshold rate or threshold amount are not exceeded, then the monitoring system continues to monitor the vehicle system, and the sensed moving speed is utilized to communicate to a PVC system to restrict the movement of the vehicle. However, if a threshold rate or threshold amount is exceeded, then the monitoring system no longer uses the sensed moving speed and instead begins to utilize a calculated speed of the vehicle system to communicate to a PVC system.

If a determination is made at step 304 to use a calculated speed, at step 306, responsive to determining that the sensed moving speed is one or more of changing at a rate that is faster than a threshold rate, or changing by more than a threshold amount, a calculated speed of the vehicle system is obtained using the monitoring system. In one example, the sensed moving speed of a vehicle is monitored using a tachometer. If the wheel slips or spins, the reading of the tachometer detects the slip or spin, and does not provide an accurate speed determination. To address this concern, the tachometer may be monitored for sudden accelerations or decelerations that are indicative of wheel slips and spins. In this manner, a threshold rate may be 2 miles per hour per second, whereas a threshold amount may be more the 5 miles per hour in a 5 second interval. Both thresholds provide indications of wheel slips or spins.

The calculated speed of the vehicle in one example is determined by a PVC system. The PVC system may be remote to the vehicle system, or on board the vehicle system. The calculated speed may be obtained by making a determination, calculation, predictions, etc. in response to a threshold being exceeded, or from receiving the calculated speed from a monitoring system that continuously determines, calculates, predicts, etc. the predicted speed. In particular, a PVC system often continuously determines the calculated speed of the vehicle by obtaining force parameters such as route grade, route curvature, resistive forces, motor tractive forces, dynamic braking, air braking, throttle position, brake pipe pressure drop, etc. These parameters may be monitored by auxiliary sensors, input into the monitoring system, received from the memory of the monitoring system, received from a remote device, calculated based on other parameters, or the like. Based on the force parameters, the calculated speed may be determined using an algorithm, mathematical equation, mathematical function, mathematical model, computer based model, lookup table, decision tree, or the like. In this manner, the monitoring system does not utilize the sensed moving speed as determined by the wheel sensor to determine the calculated speed.

At step 308, also responsive to determining that the sensed moving speed is one or more of changing at a rate that is faster than the threshold rate, or changing by more than a threshold amount at step 304, a determination is made whether a wheel slip occurred. In particular, the threshold rate and threshold amount are presented to attempt to identify potential wheel slip, and mitigate the effect of a wheel slip.

In one example, to determine if a wheel slip has occurred, the vehicle system utilizes position data to determine a positional moving speed of the vehicle system. In one embodiment the monitoring system either includes or is in communication with a global positioning system that detects the location of the vehicle system. Then based on the distance the vehicle system has traveled over a given period, the positional moving speed of the vehicle may be determined. In the example, the positional moving speed of the vehicle system is compared to the sensed moving speed of the vehicle system. If the positional moving speed and sensed moving speed match or are within a tolerance of one another, a slip has not occurred. Alternatively, if the positional moving speed and sensed moving speed do not match or are not within a tolerance of one another, then a determination is made that a wheel slip has occurred.

In another example, to determine if a wheel slip has occurred, the vehicle system compares the calculated speed and the sensed moving speed determined utilizing the wheel sensor. If the calculated speed does not match, or is not within a tolerance of the sensed moving speed determined utilizing the sensor, a wheel slip is determined to occur. In this manner, if a GPS signal is lost or cannot be found, a slip event can still be determined.

At step 310, the monitoring system returns to determining whether to restrict the movement of the vehicle system based at least on the sensed moving speed. After the determination of the wheel slip, if no wheel slip has occurred, the monitoring system switches back to restricting movement of the vehicle system by using the sensed moving speed as determined by utilizing the sensor to communicate to a PVC system. Alternatively, if a wheel slip is determined, the monitoring system continues to compare the sensed moving speed to a predicted speed such as a positional moving speed, or the calculated moving speed. Once these moving speeds converge, or are within a tolerance of one another, an indication that the wheel slip is over is provided. As a result, the monitoring system returns to using the sensed moving speed of the sensor to restrict movement, and thus returns to determining whether to restrict the movement of the vehicle system based at least on the sensed moving speed. In particular, the monitoring system continues to monitor whether a threshold rate or threshold amount is exceeded indicating another potential wheel slip has occurred.

Figure 4:
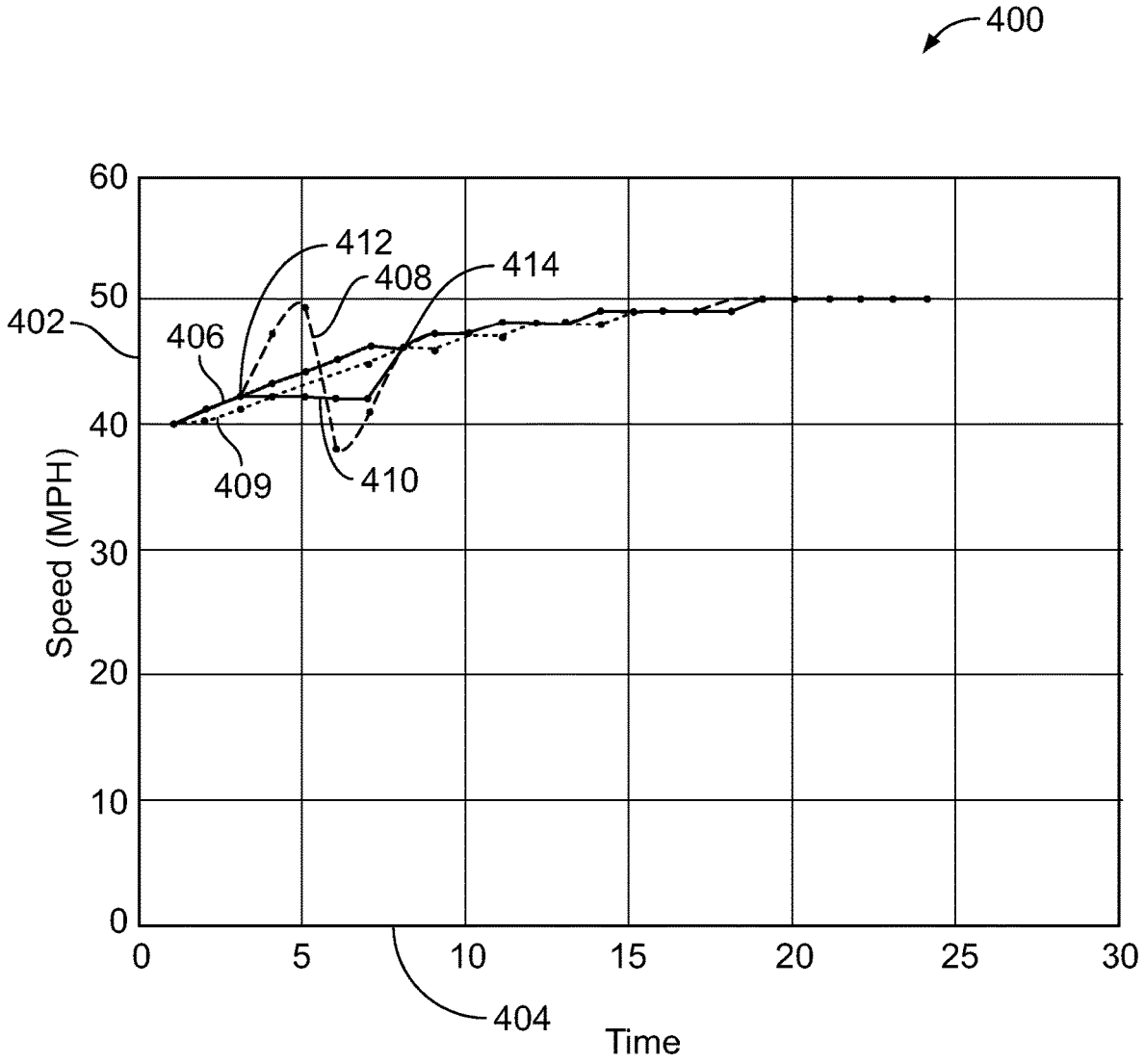
FIG. 4 illustrates vehicle speed over time.

FIG. 4 illustrates a graph 400 plotting sensed moving speed 402 over time 404 to illustrate the speed of a vehicle during a wheel slip and how the system of FIG. 2 and method of FIG. 3 can improve speed data provided for the restriction of movement of the vehicle system. Line 406 illustrates the actual speed of the vehicle system, while line 408 illustrates the wheel tach (sensor) speed, or sensed moving speed, line 409 illustrates a calculated speed, and line 410 illustrates a current method used to compensate for wheel slip where the last sensed moving speed recorded before the potential wheel slip (threshold rate or threshold amount is exceeded) is detected and used as the speed for determining restriction of movement of the vehicle.

In this example, a wheel slip occurs at point 412. As illustrated, at the wheel slip point the wheel tach speed suddenly increases compared to the actual speed of the vehicle system as the wheel freely spins. Then the sensed moving speed (e.g. tach speed) suddenly decreases compared to the actual speed of the vehicle as the wheel reengages, and finally corresponds back to the actual speed at point 414. When not mitigated, this speed fluctuation results in a controller, such as a PVC system, using incorrect speed information in restricting movement of the vehicle system. Such incorrect calculation can result in a reduction of speed of a vehicle system when such reduction is unnecessary, delaying travel, inefficient fuel consumption, and increase safety concerns.

Additionally, while using the last reported sensed moving speed as the speed to provide a PVC system and restrict the speed of the vehicle accordingly mitigates some of the speed variance of the tach speed, inefficiencies remain. Specifically, in this example, the actual speed of the vehicle is increasing, resulting in the incorrect speed being used to restrict movement until the slip is accounted for. Similarly, when the actual speed of the vehicle system is decreasing similar errors occur. In contrast, the calculated speed closely follows the actual speed of the vehicle through the entire wheel slip. Thus, while during non-wheel slip travel, the sensed moving speed may be more accurate than the calculated speed, the calculated speed is far more accurate than the sensed moving speed, or a last recorded speed during a wheel slip event. This improves calculation of a PVC system, improving travel efficiencies. Additionally, by using a calculated speed, if position data is unavailable because the vehicle system is in a tunnel, or in an area with bad reception, the wheel slip may still be identified. This again result in more accurate speed determination for the vehicle system.

In addition, when using the last reported sensed moving speed to mitigate the inaccuracies of the sensed moving speed during a slip or slide event, if the held last reported speed deviates too far from the actual speed, then a PVC system may continuously see an acceleration above the slip or slide threshold. Consequently, recovery from the slip or slide event does not occur, and mitigation simply does not occur. Specifically, a determined period, that in one example is ten seconds, may be provided for a matching of the last held reported speed and the sensed moving speed. Once the determined period lapses, the sensed moving speed is automatically utilized, even though a slip or slide event is not complete. By using the calculated speed, the determined period may be increased, because the calculated speed and actual speed of the vehicle provide far less error than holding a last know speed. This allows more time for the actual speed of the vehicle and sensed moving speed to match, causing recovery to be much more likely, and can allow the PVC system to remain active. Furthermore, using the calculated speed can allow recovery from a slip or slide event even when one sensor is unavailable such as a loss of GPS. If the predicted speed and sensed moving speed begin to match again the system can clear the slip or slide event even when out of GPS coverage, such as while in a tunnel, or if the slip or slide occurred during acceleration or deceleration.

In all, the system and method allow a PVC system to follow the calculated speed throughout the slip or slide event. The approach allows the PVC system to reduce the errors that are inaccurate for an accelerating or decelerating vehicle system and can lead to inaccuracy of the braking calculations. Specifically, the inaccurate speeds can result in unnecessary braking causing targeted travel times, fuel consumption, emissions, etc. to be missed. By using the predicted speed to determine the actual speed during the wheel slip event, a speed can be used by the PVC system that has a much higher probability of being correct than the sensed moving speed or holding the last known speed. This may allow the PVC system to ride through a longer wheel slip event and/or recover more quickly when the predicted speed begins to match the speed inputs again. As a result, the system and method benefit the PVC system and reduces route failures due to loss of speed. Additionally, the system and method improve navigation functionality and accuracy such that position error is reduced.

In one or more embodiments, a monitoring system is provided that may include a sensor that may output a sensed moving speed of a vehicle system. The monitoring system may also include one or more processors in communication with the sensor and may automatically restrict movement of a vehicle system based at least in part on the sensed moving speed. The one or more processors may also determine whether to restrict the movement of the vehicle system based at least in part on a calculated speed that is not based on the sensed moving speed, and prepare to restrict movement of the vehicle system based at least in part on the calculated speed responsive to determining that the sensed moving speed is one or both of changing at a rate that is faster than a determined threshold rate, and changing by more than a determined threshold amount. The one or more processors may also determine whether a wheel slip occurred responsive to preparation to restrict movement of the vehicle speed, and return to determining whether to restrict the movement of the vehicle system responsive to determining that the wheel slip occurred.

Optionally, the one or more processors may also compare the sensed moving speed to either of the calculated speed or a positional moving speed determined at least in part from position data, and not restrict the movement of the vehicle speed based on a determination the wheel slip occurred. In one aspect, the calculated speed may match the sensed moving speed when the calculated speed is within a determined tolerance value of the sensed moving speed, or the positional moving speed matches the moving speed when the positional moving speed is within a determined tolerance value of the sensed moving speed. In another aspect, the one or more processors may also obtain the position data from an off-board source. In one example, the one or more processors may also brake the vehicle responsive to the preparation to restrict the movement of the vehicle speed.

Optionally, the sensor may be at least one of a tachometer coupled to a wheel of the vehicle, an accelerometer, or an iterative learning control sensor. In another aspect, the calculated speed of the vehicle system is based at least in part a force parameter associated with the vehicle system. In another example, the one or more processors may also obtain the at least one force parameter from at least one of an auxiliary sensor, a memory, a positive vehicle monitoring system, or an input device. In one embodiment, the at least one force parameter may be one of route grade, route curvature, resistive forces, motor tractive forces, dynamic braking, air braking, throttle position, or brake pipe pressure drop.

In one or more embodiments, a monitoring system is provided that may include a sensor and one or more processors. The one or more processors may monitor a sensed moving speed of a vehicle system based on output from the sensor, and automatically restrict movement of a vehicle system based at least in part on the sensed moving speed. The one or more processors may also determine whether to restrict the movement of the vehicle system based at least in part on a calculated speed that is not based on the sensed moving speed. The one or more processors may also prepare to restrict movement of the vehicle system based at least in part on the calculated speed responsive to determining that the sensed moving speed is one or both of changing at a rate that is faster than a determined threshold rate, and changing by more than a determined threshold amount. The one or more processors may also determine whether a wheel slip occurred responsive to preparation to restrict movement of the vehicle speed by comparing the moving speed of the vehicle system based on the output from the sensor to either one of the calculated speed or a positional moving speed, and not restrict the movement of the vehicle speed based on a determination the wheel slip occurred.

Optionally, the calculated speed is not based on the moving speed based on the output from the sensor. In one aspect, the calculated speed may match the moving speed based on the output from the sensor when the calculated speed is within a tolerance of the moving speed based on the output from the sensor, or wherein the positional moving speed matches the moving speed based on the output from the sensor when the positional moving speed is within a tolerance of the moving speed based on the output from the sensor. In another aspect, the one or more processors may also obtain the position data from an off-board source.

In one or more embodiments a method is provided that may include sensing, with a sensor, a sensed moving speed of a vehicle system. The method may also include automatically restricting movement of the vehicle system based at least in part on the sensed moving speed, and determining whether to restrict the movement of the vehicle system based at least in part on a calculated speed that is not based on the sensed moving speed. The method may also include preparing to restrict movement of the vehicle system based at least in part on the calculated speed responsive to determining that the sensed moving speed is one or both of changing at a rate that is faster than a determined threshold rate, and changing by more than a determined threshold amount. The method may also include determining whether a wheel slip occurred responsive to preparation to restrict movement of the vehicle speed, and returning to determining whether to restrict the movement of the vehicle system responsive to determining that the wheel slip occurred.

Optionally, returning to determining whether to restrict the movement of the vehicle system responsive to determining that the wheel slip occurred may comprises comparing the sensed moving speed of the vehicle system to either one of the calculated speed or a positional moving speed. In one aspect, comparing the sensed moving speed of the vehicle system to either one of the calculated speed or the positional moving speed may include matching either one of sensed moving speed to the calculated speed, or the sensed moving speed to the positional moving speed. In another aspect, the calculated speed may match the sensed moving speed when the calculated speed is within a tolerance of the sensed moving speed, or wherein the positional moving speed matches the sensed moving speed when the positional moving speed is within a tolerance of the sensed moving speed. In another aspect, the position data may be obtained from an off-board source. In one example, the calculated speed of the vehicle system may be based on at least one force parameter associated with the vehicle system. In another example, the at least one force parameter may be one of route grade, route curvature, resistive forces, motor tractive forces, dynamic braking, air braking, throttle position, or brake pipe pressure drop.

In one embodiment, the control system, or controller, may have a local data collection system deployed and may use machine learning to enable derivation-based learning outcomes. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. In examples, machine learning may include a plurality of other tasks based on an output of the machine learning system. The tasks may be machine learning problems such as classification, regression, clustering, density estimation, dimensionality reduction, anomaly detection, and the like. In examples, machine learning may include a plurality of mathematical and statistical techniques. The machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components are restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for vehicle performance and control, behavior analytics, and the like.

In one embodiment, controller may include a policy engine that may apply one or more policies. These policies may be based at least in part on characteristics of a given item of equipment or environment. With respect to control policies, a neural network can receive input of a number of environmental and task-related parameters. The neural network can be trained to generate an output based on these inputs, with the output representing an action or sequence of actions that the vehicle should take to accomplish the trip plan. During operation of one embodiment, a determination can occur by processing the inputs through the parameters of the neural network to generate a value at the output node designating that action as the desired action. This action may translate into a signal that causes the vehicle to operate. This may be accomplished via back-propagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network are generated and then different adjustments to the parameters are made, and simulations are done. Once the output from the various models are obtained, they may be evaluated on their performance using a determined success metric. The best model is selected, and the vehicle controller executes that plan to achieve the desired input data to mirror the predicted best outcome scenario. Additionally, the success metric may be a combination of the optimized outcomes. These may be weighed relative to each other.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A monitoring system comprising:

a sensor configured to output a sensed moving speed of a vehicle system;

one or more processors in communication with the sensor and configured to:

determine a predicted speed of the vehicle system based at least in part on a throttle position and a grade of a route of the vehicle system;

compare the predicted speed with the sensed moving speed; and control movement of the vehicle system based on comparing the predicted speed with the sensed moving speed.

2. The monitoring system of claim 1, wherein the predicted speed comprises one of a calculated speed or a positional moving speed determined at least in part from position data.

3. The monitoring system of claim 2, wherein responsive to the calculated speed matching the sensed moving speed, the calculated speed is within a determined tolerance value of the sensed moving speed, or responsive to the positional moving speed matching the sensed moving speed, the positional moving speed is within the determined tolerance value of the sensed moving speed.

4. The monitoring system of claim 2, wherein the one or more processors are further configured to obtain the position data from an off-board source.

5. The monitoring system of claim 1, wherein the one or more processors are further configured to:

brake the vehicle system responsive to the comparison of the predicted speed with the sensed moving speed being above a threshold amount.

6. The monitoring system of claim 1, wherein the sensor comprises at least one of a tachometer coupled to a wheel of the vehicle system, an accelerometer, or an iterative learning control sensor.

7. The monitoring system of claim 1, wherein the predicted speed of the vehicle system is based at least in part on at least one force parameter associated with the vehicle system.

8. The monitoring system of claim 7, wherein the one or more processors are further configured to obtain the at least one force parameter from at least one of an auxiliary sensor, a memory, a positive vehicle control system, or an input device.

9. The monitoring system of claim 7, wherein the at least one force parameter comprises one or more of route curvature, resistive forces, motor tractive forces, dynamic braking, air braking, a total weight of the vehicle system or brake pipe pressure drop.

10. A monitoring system comprising:

a sensor;

one or more processors configured to:

monitor a sensed moving speed of a vehicle system based on output from the sensor;

determine a predicted speed of the vehicle system based at least in part on a throttle position and a grade of a route of the vehicle system;

compare the predicted speed with the sensed moving speed;

control movement of the vehicle system based on comparing the predicted speed with the sensed moving speed; and determine whether a wheel slip occurred based on comparing the predicted speed with the sensed moving speed.

11. The monitoring system of claim 10, wherein the predicted speed is not based on the sensed moving speed.

12. The monitoring system of claim 10, wherein responsive to the predicted speed matching the moving speed based on the output from the sensor, the predicted speed is within a tolerance of the moving speed.

13. The monitoring system of claim 10, wherein the predicted speed comprises a positional moving speed, and the one or more processors are further configured to obtain position data from an off-board source, and the positional moving speed is based on the position data.

14. A method comprising:

sensing, with a sensor, a sensed moving speed of a vehicle system;

determining a predicted speed of the vehicle system based at least in part on a throttle position and a grade of a route of the vehicle system;

comparing the predicted speed with the sensed moving speed; and controlling movement of the vehicle system based on comparing the predicted speed with the sensed moving speed.

15. The method of claim 14, wherein the predicted speed comprises one of a calculated speed or a positional moving speed.

16. The method of claim 15, wherein comparing the predicted speed with the sensed moving speed includes matching either one of the sensed moving speed to the calculated speed, or the sensed moving speed to the positional moving speed.

17. The method of claim 16, wherein responsive to the calculated speed matching the sensed moving speed, the calculated speed is within a tolerance of the sensed moving speed, or wherein responsive to the positional moving speed matching the sensed moving speed, the positional moving speed is within a tolerance of the sensed moving speed.

18. The method of claim 15, wherein position data is obtained from an off-board source, and the positional moving speed is based on the position data.

19. The method of claim 14, wherein the predicted speed of the vehicle system is based at least in part on at least one force parameter associated with the vehicle system.

20. The method of claim 19, wherein the at least one force parameter comprises one or more of route curvature, resistive forces, motor tractive forces, dynamic braking, air braking, a total weight of the vehicle system or brake pipe pressure drop.

* * * * *